US010636281B2

(12) United States Patent
Snakenberg

(10) Patent No.: US 10,636,281 B2
(45) Date of Patent: Apr. 28, 2020

(54) ACTIVE SHOOTER SECURITY SYSTEM

(71) Applicant: John M. Snakenberg, Tallahassee, FL (US)

(72) Inventor: John M. Snakenberg, Tallahassee, FL (US)

( * ) Notice: Subject to any disclaimer, the term of this patent is extended or adjusted under 35 U.S.C. 154(b) by 0 days.

(21) Appl. No.: 16/251,749

(22) Filed: Jan. 18, 2019

(65) Prior Publication Data

US 2019/0378398 A1 Dec. 12, 2019

Related U.S. Application Data

(60) Provisional application No. 62/681,169, filed on Jun. 6, 2018.

(51) Int. Cl.

| | |
|---|---|
| ***G08B 25/10*** | (2006.01) |
| ***G08B 27/00*** | (2006.01) |
| ***G07C 9/00*** | (2020.01) |
| ***G08B 15/00*** | (2006.01) |

(52) U.S. Cl.

CPC ..... *G08B 25/10* (2013.01); *G07C 9/00158* (2013.01); *G07C 9/00166* (2013.01); *G07C 9/00912* (2013.01); *G08B 15/004* (2013.01); *G08B 27/005* (2013.01)

(58) Field of Classification Search

CPC .... G08B 25/10; G08B 15/004; G08B 27/005; G07C 9/00158; G07C 9/00166; G07C 9/00912

USPC ..... 340/5.73

See application file for complete search history.

(56) References Cited

U.S. PATENT DOCUMENTS

| | | | | |
|---|---|---|---|---|
| 6,874,265 | B1 | 4/2005 | Pathak | |
| 6,888,455 | B2 | 5/2005 | Lerg | |
| 8,884,763 | B2 | 11/2014 | Hudson et al. | |
| 9,741,221 | B1 | 8/2017 | Rehfeld et al. | |
| 2014/0285668 | A1* | 9/2014 | Deweese | H04N 7/188 348/156 |
| 2015/0332528 | A1* | 11/2015 | McGinnis | E05B 65/0075 109/38 |
| 2016/0040471 | A1* | 2/2016 | Smietana | E05G 1/04 340/5.31 |
| 2016/0232774 | A1* | 8/2016 | Noland | G08B 13/1672 |
| 2016/0358393 | A1* | 12/2016 | Penland | G08B 15/00 |

* cited by examiner

*Primary Examiner* — Brian Wilson

(74) *Attorney, Agent, or Firm* — Boudwin Intellectual Property; Daniel Boudwin

(57) ABSTRACT

A security system for responding to an active shooter. The system includes a housing with a panel providing access to an interior volume thereof via a locking mechanism. The locking mechanism includes a first and second sensor corresponding to a first and second lock, respectively. Upon detection of a decibel level corresponding to a gunshot or upon actuation of a lever, the first sensor unlocks the first lock. Upon detection of an authorized user, the second sensor unlocks the second lock. Once both the first and second locks are unlocked, a weapon and garment disposed within the housing are accessible. A plurality of markers corresponding to a plurality of indicia are disposed within the housing. A marker is securable to the garment and serves to identify the authorized user to emergency responders. One of the indicia are activated at random to indicate to the authorized user which marker to don.

10 Claims, 3 Drawing Sheets

ACTIVE SHOOTER SECURITY SYSTEM

CROSS REFERENCE TO RELATED APPLICATION

This application claims the benefit of U.S. Provisional Application No. 62/681,169 filed on Jun. 6, 2018. The above identified patent application is herein incorporated by reference in its entirety to provide continuity of disclosure.

BACKGROUND OF THE INVENTION

The present invention relates to security systems. More specifically, the present invention provides a security system for responding to an active shooter.

Many public areas are vulnerable to violent attacks that include shootings. Violent attacks are difficult to stop in the course of the attack due to poorly armed and trained bystanders. Having safety measures in place provide securement and opportunity to the bystanders in order to halt the attack. Some safety measures include having weapons in a facility in order to stop the attacker. However, these weapons can be kept in an unsecured manner, making them available to being possessed by individuals with criminal intent.

Further, individuals armed with self-defense, firearms, or other weapons may be mistaken by local law enforcement as perpetrators of violent crimes, such that they may be vulnerable to a mistaken shooting directed at them by local law enforcement. Accordingly, a system that improves the safety of innocent bystanders in the event of an active shooter threat while providing qualified individuals with a measure to provide protection to themselves and other innocent individuals is desired.

Devices have been disclosed in the prior art that relate to active shooter security systems. These include devices that have been patented and published in patent application publications. These devices generally relate to security systems designed to trap an active shooter in a secure portion of a building. Some devices relate to having various sensor systems for detecting gunshots. These devices known in the art fail to disclose a system of locks operably connected to a sensor configured to activate and unlock a housing in response to detecting a gunshot.

In light of the devices disclosed in the known art, it is submitted that the present invention substantially diverges in design elements from the know art and consequently it is clear that there is a need in the art for an improvement to existing active shooter security systems. In this regard the instant invention substantially fulfills these needs.

SUMMARY OF THE INVENTION

In view of the foregoing disadvantages inherent in the known types of active shooter security systems now present in the known art, the present invention provides a new active shooter security system wherein the same can be utilized for providing convenience for the user during an active shooting.

It is therefore an object of the present invention to provide a new and improved active shooter security system that has all of the advantages of the known art and none of the disadvantages. The active shooter security system includes a housing with an open side removably covered with a panel. The panel provides access to an interior volume of the housing via a locking mechanism. The locking mechanism includes a first sensor and second sensor corresponding to a first lock and second lock, respectively. Upon detection of a decibel level corresponding to a gunshot or upon actuation of a lever, the first sensor sends a signal to a processor to unlock the first lock. Next, upon detection of an authorized user, the second sensor sends a signal to the processor to unlock the second lock. Once both the first and second locks are unlocked, a weapon and garment disposed within the housing are accessible. A plurality of markers corresponding to a plurality of indicia are disposed within the housing. A marker is securable to the garment and serves to identify the authorized user to emergency responders. One of the indicia are configured to activate at random in order to indicate to the authorized user which marker to don.

Another object of the present invention is to provide an active shooter security system that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
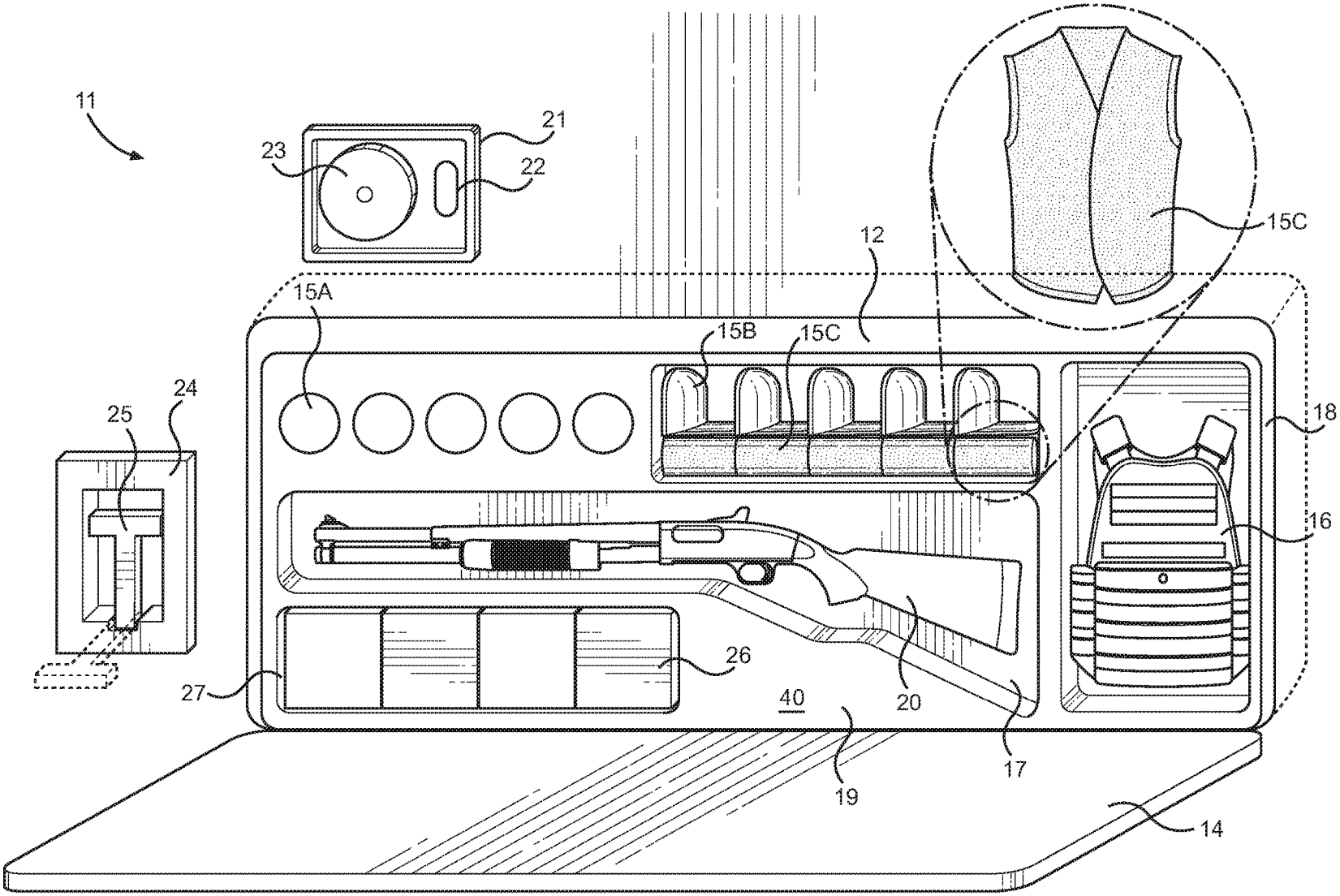
FIG. 1 shows a perspective view of an embodiment of the active shooter security system.

Reference is made herein to the attached drawings. Like reference numerals are used throughout the drawings to depict like or similar elements of the active shooter security system. For the purposes of presenting a brief and clear description of the present invention, the preferred embodiment will be discussed as used for responding to an active shooter within a building or public space. The figures are intended for representative purposes only and should not be considered to be limiting in any respect.

Referring now to FIG. 1, there is shown a perspective view of an embodiment of the active shooter security system. The active shooter security system 11 includes a housing 12 having an interior volume 19 with a plurality of compartments therein. In the illustrated embodiment, the housing 12 comprises a rear wall, a sidewall 18, and an open side opposing the rear wall. In the illustrated embodiment, the housing 12 comprises a rectangular cross section and is composed of materials of a conventional safe. In alternate embodiments, the housing 12 is composed of any material that is configured to prevent access thereto without the ability to unlock a locking mechanism that secures a panel 14 over the open side thereof. The active shooter system 11 further comprises a lever 24 to manually initiate an unlocking process and a biometric scanner 21 to detect an authorized user and complete the unlocking process.

In the illustrated embodiment, the plurality of compartments include a first compartment for storing a garment 16, a second compartment 17 for storing a weapon 20, a third compartment for receiving a garment 16, a fourth compartment 26 for receiving ammunition for the weapon, and a fifth compartment for storing a plurality of markers to be donned by the authorized user. A weapon is disposed in the second compartment, along with ammunition in the third compartment, so as to allow the authorized user the ability to stop an active attacker in a nearby proximity. In the illustrated embodiment, the weapon 20 is a 12-guage shotgun, however, in alternate embodiments the weapon is any suitable firearm configured to project ammunition. The ammunition stored in the third compartment comprises slugs, pellets, rubber bullets, and the like. In some embodiments, the third compartment further comprises pepper spray. In the illustrated embodiment, each compartment is recessed from an interior surface 40 of the housing 12.

Disposed within an upper end of the housing are the plurality of markers that correspond to a plurality of indicators. In the illustrated embodiment, each marker comprises a matching hat 15B and a vest skin 15C. In the illustrated embodiment, the hat 15B and the vest skin 15C comprise a matching color. However, in alternate embodiments, the hat 15B and the vest skin 15C comprise a corresponding number or some other indicia configured to match. The vest skin 15C is configured to be worn over the garment. The indicia that dictates which marker is to be worn by the authorized user is further configured to be communicated to emergency responders. The communication of the indicia serves to alert the emergency responders of the identity of the authorized user. This is to prevent law enforcement from inadvertently thinking that the authorized user, who may be in possession of the weapon, is an active shooter. In alternate embodiments, the markers are a single article configured to cover the garment or be donned on somewhere on the person of the authorized user.

The plurality of indicia serves to indicate to the authorized user which marker to choose and place over the garment. Each indicia correspond to each marker. For example, in the illustrated embodiment, each indicia is an LED light source 15A having a color that corresponds to a single set of the hat 15B and vest skin 15C. One of the LED light sources 15A is configured to randomly illuminate when the housing is unlocked, thereby exposing the interior of thereof. The indicia are operably connected to a processor that allows an algorithm to cause the random selection thereof. The reason the indicia is randomly selected so as to prevent an active shooter from anticipating what marker the authorized user will be donning in the event of an active shooting.

Figure 2:
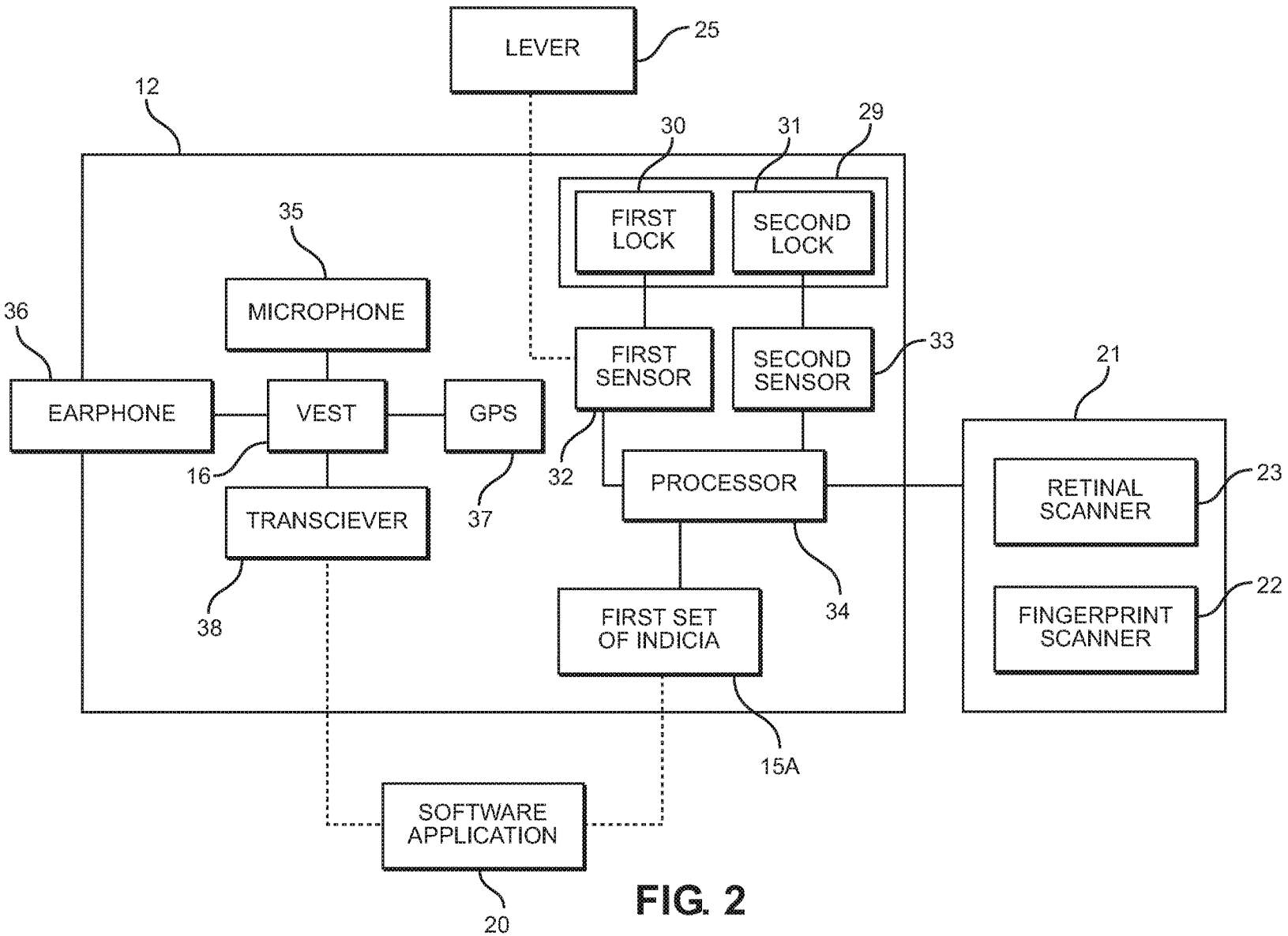
FIG. 2 shows a block diagram of a control circuit of an embodiment of the active shooter security system.

Referring now to FIG. 2, there is shown a block diagram of a control circuit of an embodiment of the active shooter security system. In the illustrated embodiment, the garment is a bullet-proof vest 16 that is configured to be donned by the authorized user in the process of confronting an active shooter. The bullet-proof vest 16 comprises a microphone 35, an earphone 36, a GPS 37, and a wireless transceiver 38. The microphone 35 and earphone 36 allow the authorized user to communicate with emergency personnel and law enforcement. The GPS 37 allows the authorized user to alert law enforcement of his or her position via the wireless transceiver 38. In some embodiments, the active shooter security system comprises a software application 20 that is enabled to communicate with and receive information from the wireless transceiver 38 disposed within the bullet-proof vest.

In the illustrated embodiment, the panel entirely covers the open side of the housing 12 in order to provide selective access to the interior volume 17 thereof. The panel is separable from the open side of the housing 12 via a locking mechanism. The locking mechanism 29 is operably connected to the processor 34 and includes a first sensor 32 and a second sensor 33. The first sensor 32 corresponds to a first lock 30 and the second sensor corresponds to a second lock. The first sensor 32 is configured to detect a decibel level corresponding to a gunshot. In the illustrated embodiment, the decibel level detected corresponds to the decibel level of a gunshot no more than 50 feet away from the first sensor. In alternate embodiments, the detection of the decibel level of the first sensor varies upon size of the building in which the active shooter system 11 is installed.

The first sensor is further configured to detect manual actuation of the T-shaped handle of the lever 25 (shown in FIG. 1, 24, 25). The lever 25 can be similar to a fire alarm lever installed on a wall of a building. The lever 25 is operably connected to the first sensor 32 and can be actuated by any person having access to the handle. In some embodiments, the lever 25 is configured to mark a person that actuates the lever with ink in order to deter or prevent a number of false alerts. Once the first sensor 32 detects a threshold decibel level or actuation of the lever 25, the first lock 30 is unlocked and the second sensor 33 of the locking mechanism 29 is activated for detection.

In the illustrated embodiment, the second sensor 33 is operably connected to a biometric scanner 21 that is configured to detect the authorized user. In the illustrated embodiment, the biometric scanner 21 includes a retinal scanner 23 and a fingerprint scanner 22. upon detection of an authorized user, the second sensor 33 sends a signal to unlock the second lock 31. In alternate embodiments, the biometric scanner 21 is replaced with a keypad or other alphanumerical input that allows the authorized user to input a passcode for unlocking the second lock. Once both the first and second locks 30, 31 are unlocked, the panel is separated from the housing and the interior thereof is accessible. In the illustrated embodiment, the first sensor 32 must detect an event, defined as the threshold decibel level or actuation of the lever, in order for the first lock to be unlocked and the second sensor to be in operation. Once the second sensor is in operation, the second lock can be unlocked upon detection of the authorized user via the biometric scanner.

Figure 3:
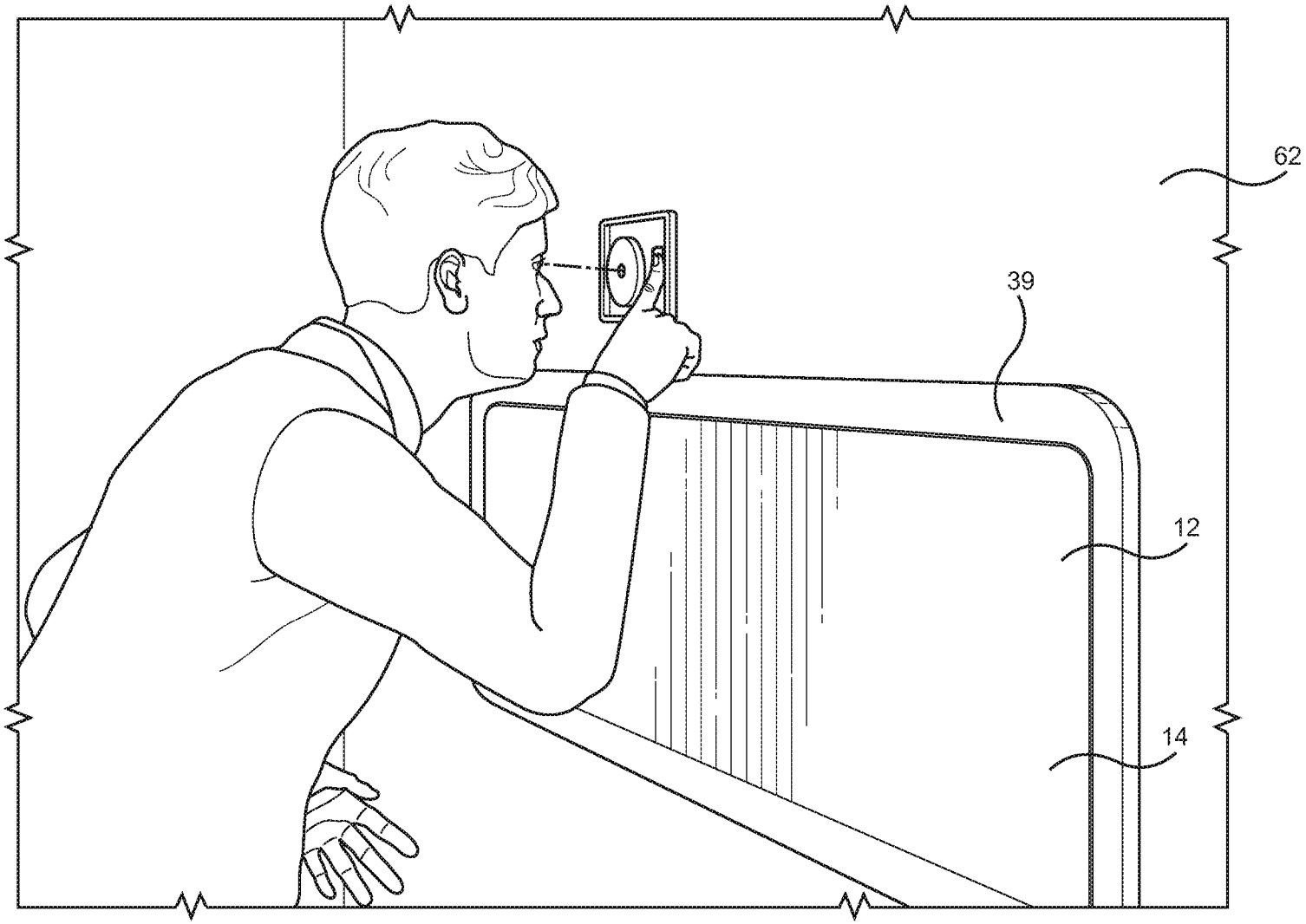
FIG. 3 shows a perspective view of an embodiment of the active shooter security system in use.

Referring now to FIG. 3, there is shown a perspective view of an embodiment of the active shooter security system in use. In the illustrated embodiment, the housing 12 is configured to rest recessed within a wall 62 such that the open side thereof is aligned with the exterior of the wall 62. A lip 29 surrounds the perimeter of the open side of the housing and rests on the exterior of the wall 62. The panel 14 rests in the same plane of the lip when the panel 14 is in the locked position. In operation, the first sensor detects an event and signals to the processor to unlock the first lock and activate the second sensor. When the second sensor detects the authorized user, the second lock unlocks and allows the authorized user to access the interior of the housing. Once the second sensor unlocks the second lock, a signal is sent to the processor to randomly select and illuminate one of the LED light sources via the algorithm. The authorized user dons the garment and determines which marker to select by the illumination of the indicator. Once the markers are placed on the authorized user's person, he is able to arm himself with the weapon and necessary ammunition. The bullet-proof vest allows the authorized user to communicate with law enforcement and disclose the indicia that was randomly selected. In alternative embodiments, the processor is operably connected to the software application that enables law enforcement to determine the indicia through access to the software application.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An active shooter security system, comprising:

a housing having an open side allowing access to an interior volume thereof, wherein the open side is removably covered via a panel;

the panel having a locking mechanism, wherein the panel is movable from a locked position to an unlocked position, such that in the locked position access to the interior volume of the housing is prevented;

a first sensor operably connected to the locking mechanism and a lever, wherein the first sensor is configured to unlock a first lock of the locking mechanism upon detection of decibel level that corresponds to a gunshot or when the lever is actuated;

a second sensor operably connected to the locking mechanism, wherein the second sensor is configured to unlock a second lock of the locking mechanism upon detection of an authorized user;

wherein the panel only moves to the unlocked position when the first lock and second lock are unlocked;

a weapon and a garment disposed within the housing;

a plurality of markers disposed within the housing configured to be secured to the garment, wherein each marker is configured to identify the authorized user to emergency responders;

a plurality of indicators each corresponding to a marker of the plurality of markers, wherein each of the plurality of indicators comprise a different indicia from one another.

2. The active shooter security system of claim 1, wherein the second sensor is a retinal scanner or fingerprint scanner.

3. The active shooter security system of claim 1, once the panel is opened, the system sends a signal to law enforcement.

4. The active shooter security system of claim 1, wherein the garment comprises a bulletproof vest.

5. The active shooter security system of claim 1, wherein each marker of the plurality of markers comprises a corresponding hat and vest, wherein the vest is configured to fit over the garment.

6. The active shooter security system of claim 1, the first sensor is operably connected to a building alarm system, such that when the first sensor simultaneously unlocks the first lock it activates the building alarm system.

7. The active shooter security system of claim 1, further comprising a first and second compartment disposed in the housing, wherein the first compartment is configured to receive the garment and the second compartment is configured to receive the weapon.

8. The active shooter security system of claim 7, further comprising a third compartment having ammunition for the weapon.

9. The active shooter security system of claim 1, wherein the garment comprises an integrated microphone, a gps, an earphone, and a wireless transceiver.

10. The active shooter security system of claim 1, wherein the plurality of indicators each comprise a different colored light source configured to illuminate when the locking mechanism is unlocked.

* * * * *